US007500443B1

(12) United States Patent
Allen

(10) Patent No.: US 7,500,443 B1
(45) Date of Patent: Mar. 10, 2009

(54) HOLDER FOR A CONTAINERIZED BEVERAGE

(76) Inventor: Donald Terry Allen, 47 Acorn Rd., Madison, CT (US) 06443

( * ) Notice: Subject to any disclaimer, the term of this patent is extended or adjusted under 35 U.S.C. 154(b) by 0 days.

(21) Appl. No.: 11/787,347

(22) Filed: Apr. 16, 2007

(51) Int. Cl.
*B63B 17/00* (2006.01)
*F21V 33/00* (2006.01)
*A47K 1/08* (2006.01)

(52) U.S. Cl. ..... 114/343; 362/154; 248/311.2

(58) Field of Classification Search ..... 114/343
See application file for complete search history.

(56) References Cited

U.S. PATENT DOCUMENTS 6,092,905 A * 7/2000 Koehn ..... 362/101
6,896,387 B2 * 5/2005 Renfro ..... 362/602

* cited by examiner

*Primary Examiner*—Jesus D Sotelo
(74) *Attorney, Agent, or Firm*—William B. Gowanlock

(57) ABSTRACT

A lighted holder for holding a container having therein an individual serving of a liquid, such as a beverage. In one application, the cup holder is installed in a hull of a boat.

21 Claims, 10 Drawing Sheets

HOLDER FOR A CONTAINERIZED BEVERAGE

FIELD OF THE INVENTION

The present invention relates to a holder and more specifically to a holder for temporarily securing a container, such as a can, bottle, or cup, sized to hold an individual serving of a liquid, such as a beverage.

BACKGROUND

A generic term for holders for temporarily securing a container sized to hold an individualized serving of a beverage is "cup holders." While the term "cup holder" implies a holder for cups, over time the term "cup holder" has been used to refer to any holder that secures a broad range of individual serving beverage containers, such as cans or bottles having therein soda or juices, to cups of all sizes containing both hot and cold liquids.

Cup holders are ubiquitous. They are found in numerous items, such as cars, boats, train cars, airplanes and even furniture. There is even evidence that the availability, placement, and style of cup holders in these items can lead to a competitive advantage. For example, a well-designed boat may not sell because it lacks cup holders, or the installed cup holders are not in desirable locations. Conversely, a cup holder, or the placement of cup holders, may seal the item's sale.

Over the years, cup holders of various styles have been designed to attract buyers for the items that have them. For example, cup holders have been designed that adjust in size to accommodate a broader range of sizes and shapes of containers than might otherwise been held by cup holders of fixed dimensions. Other cup holders have been designed that retract so they can be concealed when not in use.

As the cup holder has become such a central focus for purchasers of items that incorporate them, designers are constantly seeking cup holders that incorporate features that will entice customers to purchase the item into which it is placed. What is needed in the art is a cup holder that attracts customers in a way previous cup holders have not.

SUMMARY OF INVENTION

This invention is a lighted cup holder. In one application, the cup holder is placed in a hull of a boat for use by the boat's operator and passengers.

These and other features, aspects, and advantages of embodiments of the present invention will become apparent with reference to the following description in conjunction with the accompanying drawings. It is to be understood, however, that the drawings are designed solely for the purposes of illustration and not as a definition of the limits of the invention.

DETAILED DESCRIPTION

Figure 1:
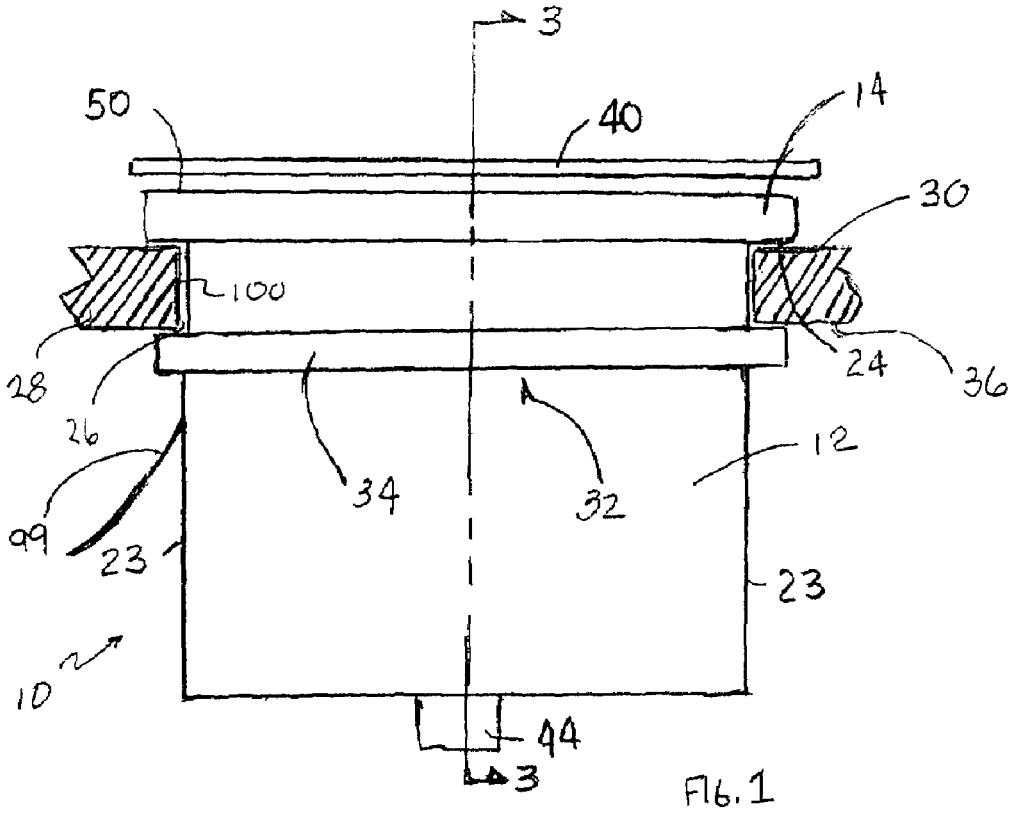
FIG. 1 is a side view drawing of a cup holder in a body, where the body has been sectioned.
Figure 2:
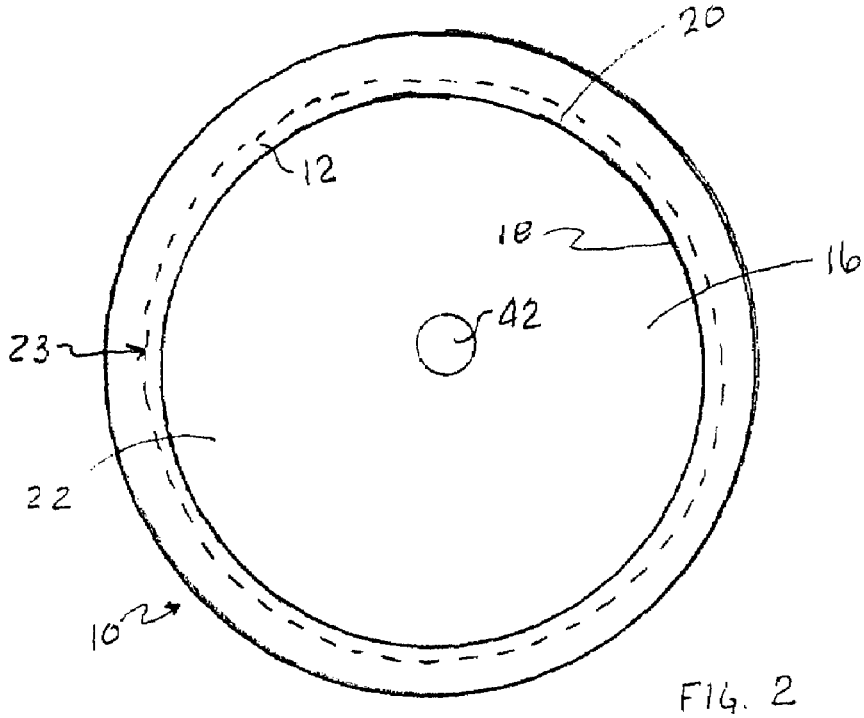
FIG. 2 is a top view drawing of the cup holder of FIG. 1.
Figure 3:
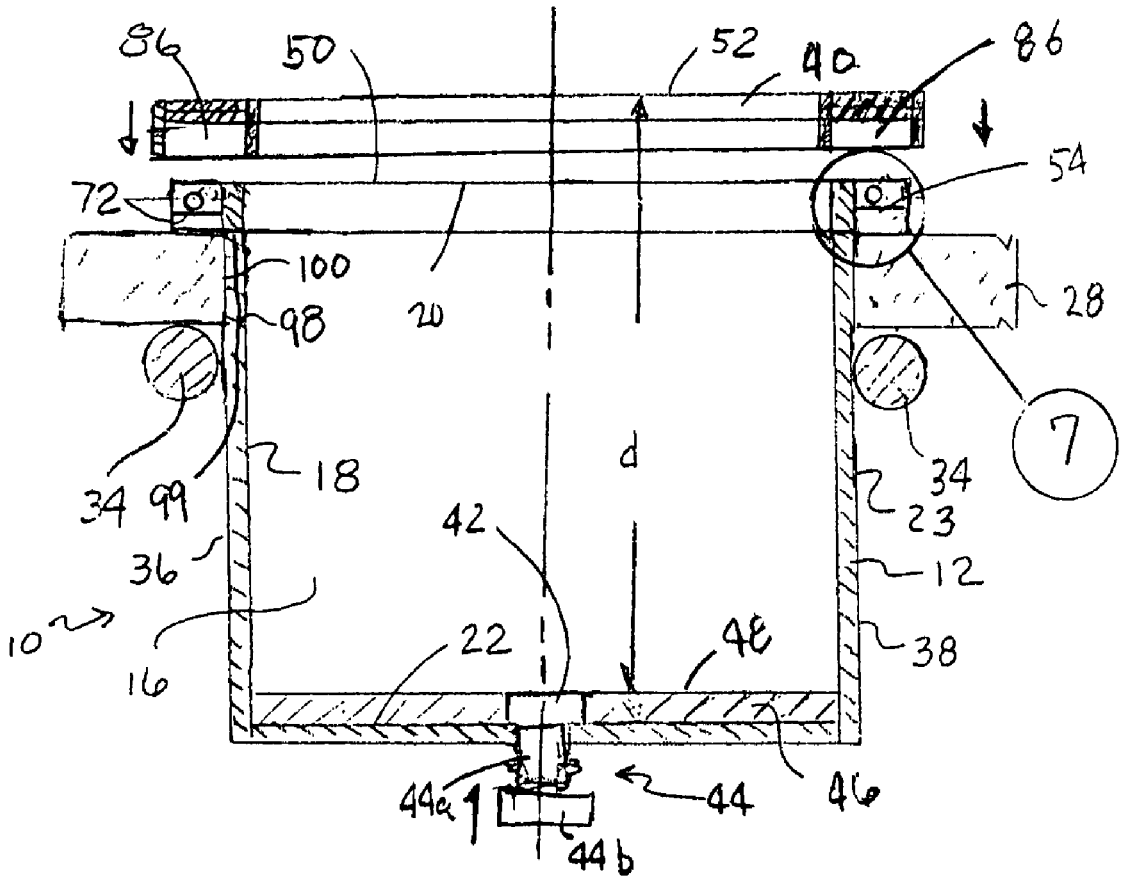
FIG. 3 is an expanded sectional view drawing of the cup holder of FIG. 1 taken along line 3-3.

As shown in FIGS. 1, 2 and 3, the cup holder (generally referred to by reference number 10) includes a base 12 and a rim 14. The base 12 defines a chamber 16, which is shown as cylindrical, having an inner surface 18 that defines an opening 20, and having a bottom 22. The base 12 also has an exterior surface 23, which may be cylindrical. A cylindrical exterior surface 23 facilitates mounting the cup holder 10, which is discussed below.

The rim 14 extends radially outward from the base 12 around the base creating an abutting surface 24. The rim 14 may be placed on the base 12 proximate the opening 20.

In an installation of the cup holder 10 in an item (e.g., boat), the abutting surface 24 of the rim 14 acts as a stop that permits the cup holder to be installed through a hole 26 defined by a body 28 of an item (e.g., a hull of a boat). The hole 26 is dimensioned to allow that portion of the cup holder 10 being inserted to enter and pass through, but not the rim 14. Thus, the abutting surface 24 comes to rest on a surface 30 of the body 28.

As shown in FIGS. 1 and 3, the cup holder 10 may include a keeper (generally referred to by reference number 32). The keeper 32 cooperates with the abutting surface 24 of the rim 14 to secure the cup holder 10 in the body 28.

As illustrated, the keeper 32 may be an elastic band 34. In use, the elastic band 34 is stretched and placed around the base 12 after the cup holder 10 has been placed in the hole 26. The elastic band 34 may be held on the base 12 by friction. The elastic band 34 is preferably located on the base 12 such that it simultaneously contacts the base and an under surface 36 of the body 28; thereby effectively trapping the cup holder 10 in the body.

A keeper 32 of the elastic band type is a non-blind keeper. A non-blind keeper is a keeper that is installed from the backside (backside access) of a body into which the cup holder 10 is installed. As shown in FIG. 1, the cup holder 10 would be inserted into the body 28 and the non-blind keeper installed on the cup holder 10. As this keeper 32 is a temporary, non-blind keeper, if the backside can be accessed, the keeper could be removed and the cup holder taken out of the body and reinstalled.

As those skilled in the art of installing items such as cup holders in bodies will appreciate, an elastic band type keeper may provide installation flexibility. More specifically, an elastic band 34 can be positioned anywhere along the base 12. As a result, the thickness of the body 28 need not be precisely known, or controlled.

The only requirement is that the base 12 be able to accommodate properly the elastic band 34. Ideally, some portion of the base 12 should extend outwardly from the under surface 36 of the body 28; thereby avoiding the need to provide a countersink (not shown).

In order to assure that the elastic band 34 remains on the base 12, the base's exterior surface 23 in at least an area where the elastic band is mounted should have parallel sides (e.g., if circular a right circular cylinder shape). In the illustrative case shown in FIG. 1, the cup holder's 10 exterior surface 23 has a right circular cylinder shape below the rim 14. Thus, the sides are parallel. If this is not the case and there is any taper in the direction of the bottom 22, the elastic band 34 will have a natural tendency to slide down the base 12, which would cause the cup holder 10 to wobble in the hole 26. In the extreme, the elastic band 34 may even fall off the cup holder 10 thereby permitting the cup holder to exit the body 28.

Figure 4:
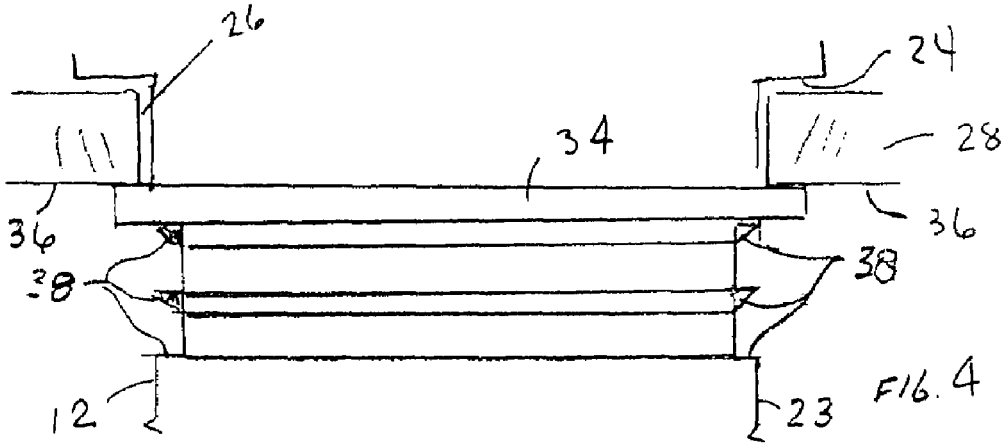
FIG. 4 is a side view of the cup holder of FIG. 1 in the area between the cup holder's abutting surface and a point on the base to illustrate an alternative configuration of the base.
Figure 5:
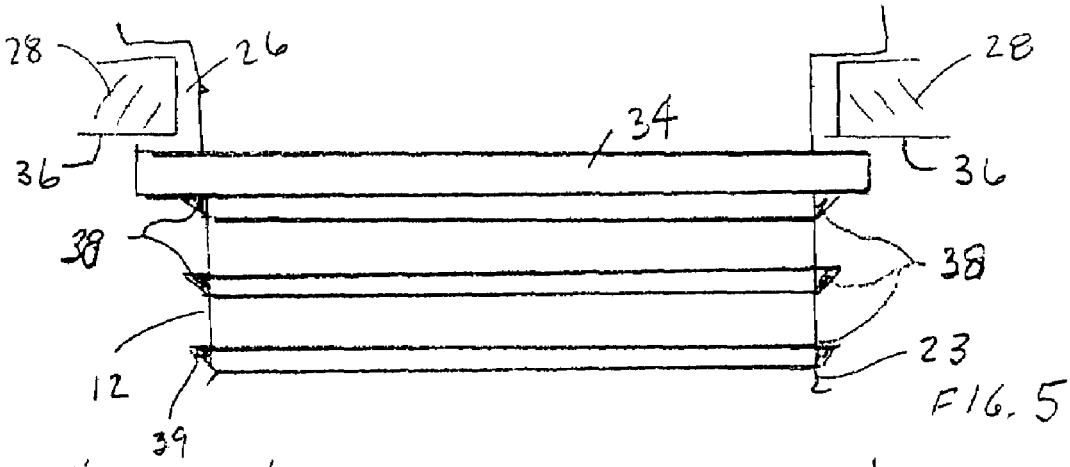
FIG. 5 is a side view of the cup holder of FIG. 1 in the area between the cup holder's abutting surface and a point on the base to illustrate another alternative configuration of the base.

As shown in FIGS. 4 and 5, the base 12 may also have ridges 38 on the exterior surface 23. These ridges 38 can be used to assist in securing the elastic band 34 in position. More specifically, the ridges 38, one or more, would be placed on the exterior surface 23 at distances relative to the abutting surface 24 such that the elastic 34 when properly placed on a base 12 installed in a body 28 will have a placement between a ridge 38 and the anticipated under surface 36. Multiple ridges 38 can be used to account for bodies 28 of various thicknesses. Ridges are particularly advantageous where the exterior surface 23 tapers in the area where the elastic band 34 will be mounted.

Figure 6:
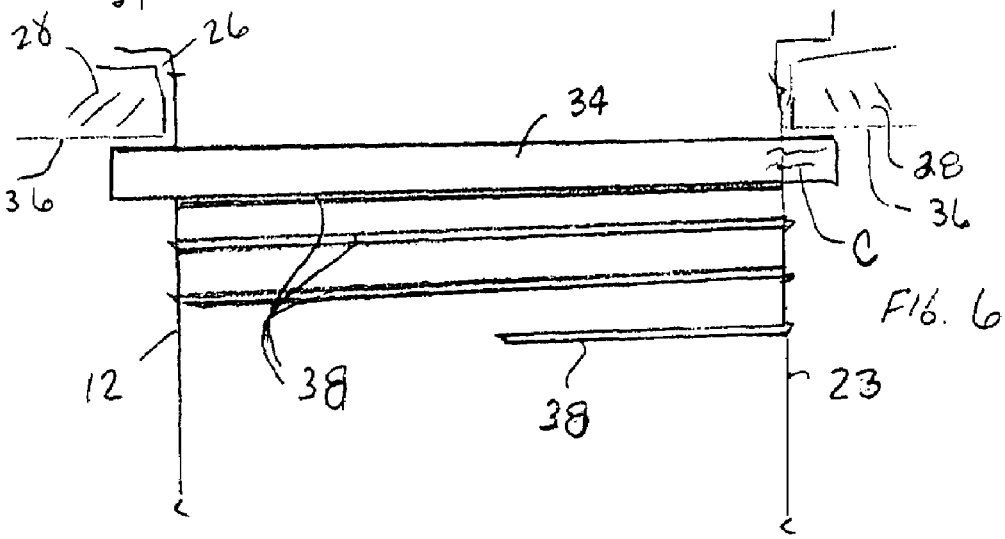
FIG. 6 is a side view of the cup holder of FIG. 1 in the area between the cup holder's abutting surface and a point on the base to illustrate yet another alternative configuration of the base.

As shown in FIG. 6, the ridges 38 could define threads thereby permitting the elastic 34 to be operated much like a nut, of a nut and bolt combination. As illustrated, the ridges 38 extend outwardly from the exterior surface 23 of the base 12. If a threaded configuration is used, ideally the elastic 34 should be sufficiently compressible, such as in area C, to permit it to conform to the thread's angle and the under surface 36 for maximum contact.

It should be appreciated that when the ridges 38 extend outwardly from the body 28 they increase the base's 12 outside diameter, but when recessed into the base they do not. Thus, the ridges 38 may need to be taken into account when the hole 26 defined by the body 28 is made.

Where the cup holder 10 is to be friction fit (e.g., not employing a keeper) into the hole 26, the area of the exterior surface 23 that will be exerting a force on the hole's 26 perimeter (e.g., the area immediately below the abutting surface 24) should have parallel sides. Thus, where the base 12 is circular, this area should be a right circular cylinder shape. If there is an inward taper extending away from just under the rim, the cup holder with appear fixed when initially inserted, but could work its way out if subject to vibration.

Continuing with FIG. 1, the cup holder 10 may include a cap 40. The cap 40 is secured to the rim 14. The cap 10 can be made of such materials as polished stainless steel or plastic. If needed, the material should be passivated, if needed based on the application. Additional features that the cap 40 may have are discussed below.

As shown in FIGS. 2 and 3, the cup holder 10 may also include a drain 42. The drain 42 is preferably positioned at the lowest point in the base 12 in this case the bottom 22, and the bottom may even be contoured to create a low point. The drain 42 may have a nipple 44 such that a drain line (not shown), which may be part of a drainage system of the item in which the cup holder 10 is installed, can be connected to the nipple. For example, if the cup holder 10 is installed in a boat, a drain line may extend into the boat's bilge or a holding tank.

The nipple 44 can be of any size, or multiple sizes. For example, the nipple 44 may have a nipple base section **44*a* and nipple sleeve 44*b* that attaches, such as by threads, to the nipple base section. The nipple base section 44*a* accommodates a $\frac{3}{8}^{th}$ inch hose, while the nipple 44 with the nipple sleeve 44*b* may accommodate a $\frac{5}{8}^{th}$ inch hose. The nipple 44** may as options have closed ends or incorporate other attachments, such as 90-degree fittings.

Referring to FIG. 3, the cup holder 10 may optionally include a pad 46, which may be ultra-violet enhanced, if needed based on the application. The pad 46 is positioned in the chamber 16 on the bottom 22. Depending upon the container placed into the cup holder 10, the pad 46 may be soft to provide cushioning, or reduce noise from the interaction of the container with the cup holder.

A particular cup holder 10 has at least one working depth d. The working depth as used herein is the inside distance from a shelf in the chamber 16 on which the container sits to the top of a cup holder 10. The location of a particular shelf is container dependent. In other words, the cup holder 10 may be designed to accommodate multiple containers, thus may have multiple shelves. Where there are multiple shelves, the cup holder 10 will have multiple working depths.

The cup holder 10 illustrated in FIG. 3 has a single shelf, which is the bottom 22. Thus, this design of cup holder 10 has a single working depth d. While the working depth is generally considered to be the distance between the bottom 22 and the opening 20, the precise working depth may vary based on a particular configuration. If a pad 46 is present and no cap 40, the precise working depth is from the pad's exposed surface 48 to the base's top 50. If a cap 40 is added, the precise working depth is from the pad's exposed surface 48 to the cap's 40 outer surface 52 (case illustrated). It should be appreciated that where the thickness of the pad 46 or cap 40 are minimal, the effect on the working depth is negligible. Thus, in these cases these thicknesses are generally ignored.

The particular working depth of a cup holder 10 is based on the container with which the cup holder is to be used and the item in which the cup holder will be used. For example, for a cup holder holding a 12-ounce can, a working distance d for a car will be different from a boat. This difference results due to the different forces that will act upon the container in these different items. Boats, for example, typically impose greater centrifugal and vertical forces on a container in a cup holder than cars. Thus, a cup holder 10 of a working depth suitable for a car is unsuitable for a boat.

More specifically, a cup holder 10 for a particular container in a boat will generally have a working depth greater that that for a car. This will enhance the ability of the cup holder 10 to retain the container in rough seas and/or shape turns. For example, a standard 12-ounce beverage can, (e.g., for soda or beer) is a 211×413, which is 2 and $\frac{11}{16}^{th}$ inches in diameter (beverage cans use a sizing system where the first number is inches and the last two numbers are the number of 16ths) and 4 and $\frac{13}{16}^{th}$ inches in height. In a boat application, the center of gravity of the container, when full, when placed in the cup holder 10 should be proximate the opening 20, to avoid an inherently unstable mounting of the can in the cup holder. Thus, assuming the center of gravity of a full, or slightly consumed, 12-ounce can is about half its height, a satisfactory working depth is about 2⅜ inches. This further assures that the mounting of the can in the cup holder 10 remains inherently stable as the contents of the can are consumed.

The diameter of the opening 20 should be large enough (e.g., provide a clear ¼ inch) to allow the can to be easily slid in and out of the cup holder. Where a ¼-inch clearance is provided, the cup holder will have a diameter ½ inch larger than the can. If the diameter is overly large, the container will wobble around in the cup holder 10. Thus, waves induced in the liquid from the movement of the item in which the cup holder 10 is installed will be exacerbated by the additional movement of the container in the cup holder, which may cause some of the contents of the container to be spilled. As with the working depth, the diameter of the opening 20 may be reduced if a cap 40 is present. This reduction is generally minimal and is thus ignored.

Additionally, this sizing assures that there will be a sufficient amount of the can extending outwardly for the holder, such that the can may be grabbed by a hand and extracted from the cup holder. If the can were a stubby beverage can (211×310), which has a height of 3 inches and $^{10}/_{16}{}^{th}$ but generally, the same diameter as the standard 12-ounce beverage can, the can would only have about 1 inch and $^{4}/_{16}{}^{th}$ exposed. This would be about 1 inch less that for the standard 12-ounce can. The stubby can would be hard to grab if it were dry and almost impossible if moisture, (e.g., condensation) is present.

It should be appreciated that a cup holder designed for a 12-ounce can having the above dimensions will hold standard water bottles of the same or smaller diameter. The standard water bottle has a diameter about the same, or nominally smaller, than the standard can, but is taller (8 inches or so excluding the empty neck portion). The working depth of the cup holder 10 provides reasonable dimensions to bind the water bottle in the cup holder 10, but the center of gravity of a full, or slightly consumed, water bottle would be above the top.

Based on the above, a cup holder 10 might have the following dimensions. The chamber 16 would have an internal diameter of between 80-90 mm, while the base 12 might have an external diameter between 90-100 mm. The rim 14 would have an exterior diameter of between 110-120 mm. The depth to the step would be between 60-70 mm. If a second step were included, it would have an internal diameter of 60-70 mm and a depth of between 80-90 mm.

Referring to FIG. 3, the rim 14 defines a channel 54. Continuing with FIG. 7, the rim 14 has a perimeter 56, in this case defined by four sides—an inside side 58, an outside side 60, a top side 62 and bottom side 64. The channel 54, as illustrated is generally continuous around the rim 14.

As illustrated, the rim's inside side 58 is also part of the base 12. In this illustrative example, the base 12 and portions of the rim 14 were created in a single unit. More specifically, the base 12 (a part of which is coincidentally the inside side 58), the top side 62, and the outside side 60 were created using a single mold. The bottom side 64 was an individual piece that was secured in place, which completed the rim 14. It should be appreciated that other methods of manufacture could be used as well as shapes, thus individual sides by not be readily identifiable.

Figure 7:
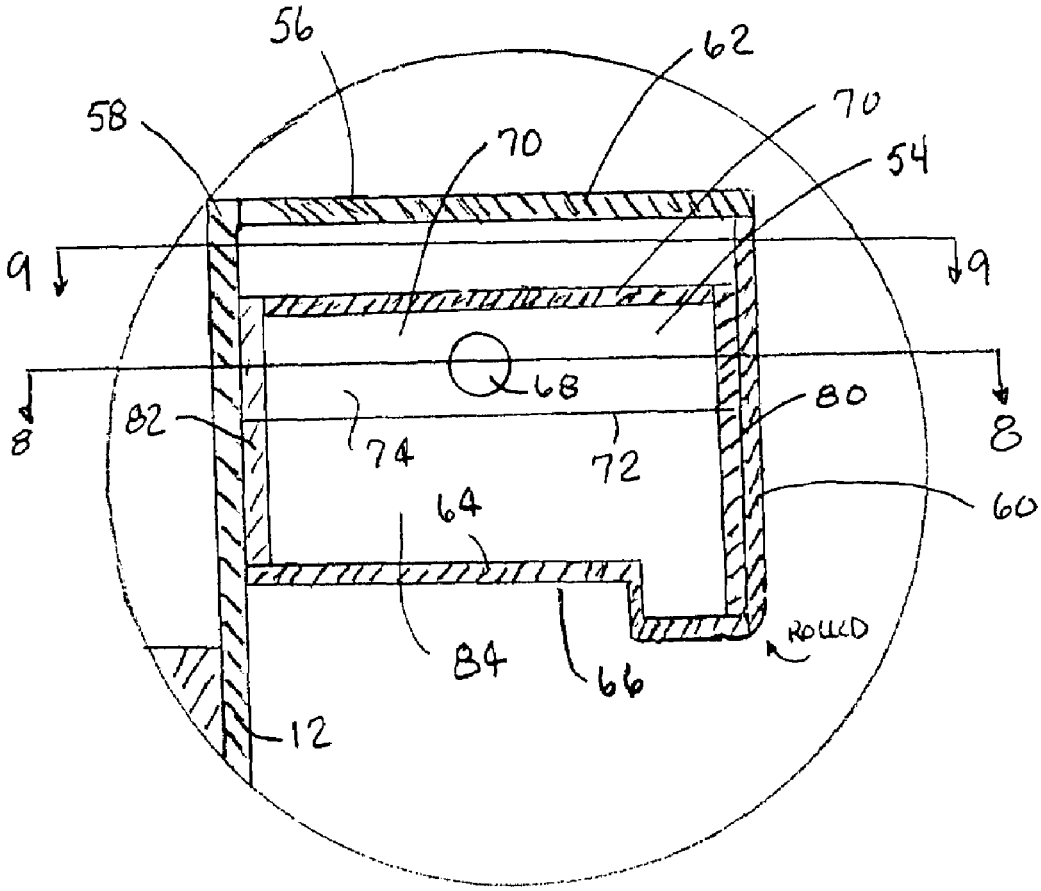
FIG. 7 is an expanded view drawing of the cup holder's rim from area 4 in FIG. 3.

As shown in FIG. 3 and more clearly in FIG. 7, the bottom side 64 of the perimeter 56 may define a groove 66. The groove provides a recess to accept a bedding compound (not shown) when the cup holder 10 is mounted, such as in a boat. Additionally, where in the bottom side 64 meets the outside 60 the corner that is created should be rounded, or rolled, not square. A square corner will tend to tear fabrics, such as vinyl, if the cup holder 10 is installed through them.

Figure 8:
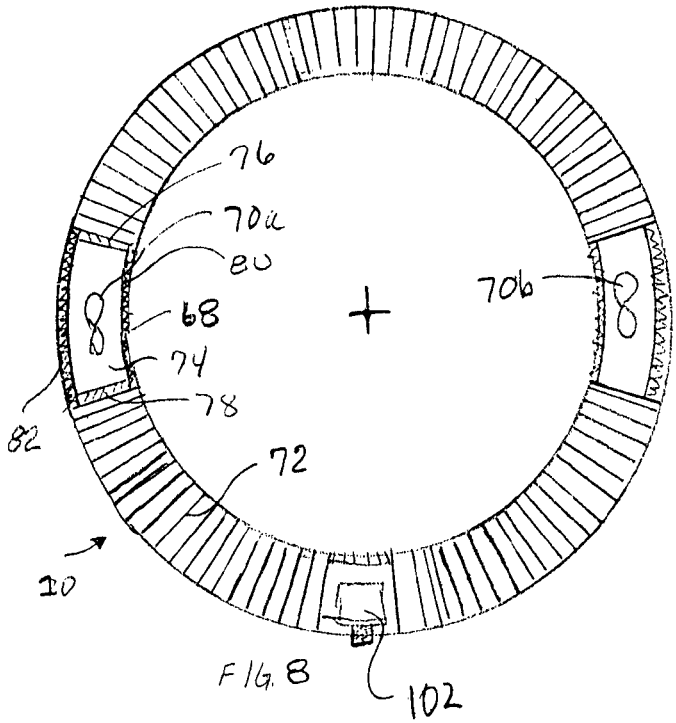
FIG. 8 is a top view drawing of the cup holder's diffuser shown in part in FIG. 7 taken along line 8-8.

Continuing with FIG. 7, positioned in the channel 54 is a light source, generally referred to by reference number 68. Referring to FIG. 8, the illustrated light source 68 includes two light units 70*a*, and 70*b*, each having two bulbs (e.g., Light Emitting Diodes, "LEDs," which use minimal power and give off little heat). Depending upon the transparency of the perimeter 56 of the rim 14, the light from the light source 68 may be visible to an observer of the cup holder 10 from multiple perspectives. If at least some portion of the perimeter 56 is translucent, the light from the light source 68 will be visible through the rim 14. If the entire perimeter 56 is transparent, the rim 14 will be totally illuminated.

Figure 9:
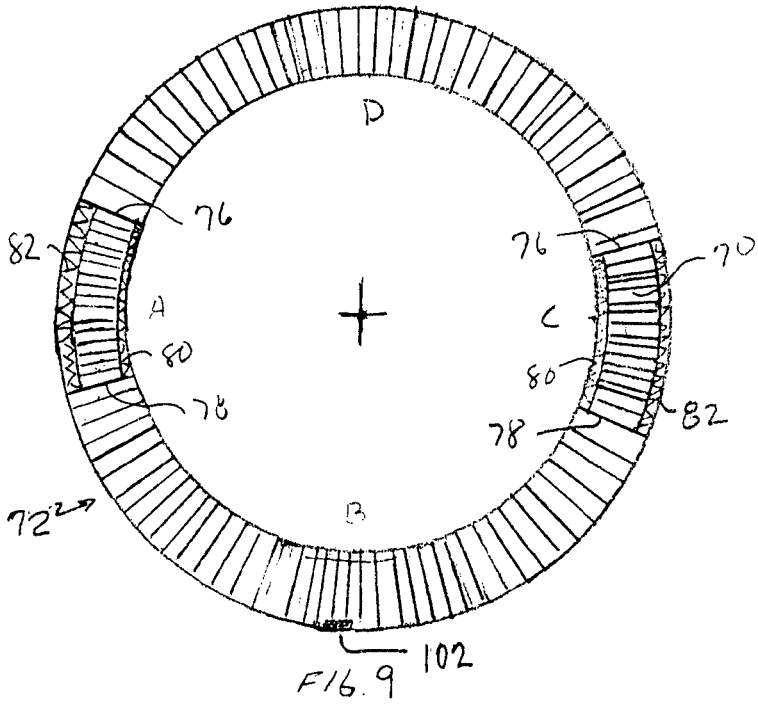
FIG. 9 is a top view drawing of the cup holder's diffuser shown in part in FIG. 7 taken along line 9-9.

As shown in FIGS. 3 and 7, the rim 14 may have therein a light diffuser, generally referred to by reference number 72. A light diffuser acts to disperse the light from a point light source to create a glow. Referring to FIGS. 8 and 9, the particular light diffuser 72 illustrated is a translucent ring that has ridges on one side. Where the light diffuser 72 encounters a light unit 70*a*, 70*b*, the ring is displaced to form a chamber 74. As a result of the displacement, the chamber 74 has two ends 76, 78 that block light and two sides 80, 82. The sides 80, 82 are made from translucent material, which is also ridged.

As shown in FIG. 7 because of the light diffuser 72, the light emitted from the light source 68 travels in a light passage 84, which is defined by the rim 14 and the light diffuser 72. If the light diffuser 72 and any portion of the rim perimeter 56 above the light diffuser are translucent, the light under the light diffuser will appear to cause the light diffuser to glow.

It should be appreciated that the precise design of the channel 54 and the placement of light source 68 and the light diffuser 72 therein is a matter of design choice.

The light can be of any color, such as red, green, blue, yellow and white. In a boat, red and green, for port and starboard, respectively, may be desired. Blue would also be desired, as it is a common accessory color. In addition, the lights could be multiple colors and having a lighting pattern, e.g., flashing.

As stated above, the cup holder 10 may include a cap 40. Depending upon the material from which the cap 40 and rim 14 are made, the cap may act as a shade for the rim 14. As shown in FIG. 3, the cap 40 defines a rabbet 86 that permits the cap 40 to be slid over and be affixed (e.g., by friction or adhesive) to the rim 14. Referring to FIG. 7, if the top side 62 of the rim 14 is translucent and the cap 40 is not, the cap will block all light coming through the top. If the cap 40 is non-translucent and the depth of the rabbet 85 is less than the thickness of the rim 14, the light will be emitted through some portion of the sides 60, 62 of the rim 14. It should be appreciated that the illustrated rabbet 86 has equal sides, but this is not required. Sides of different lengths may be used. Sides of different lengths would permit, for example, blocking all the light being emitted from the outside side 60, but not the inside side 58.

Figure 10:
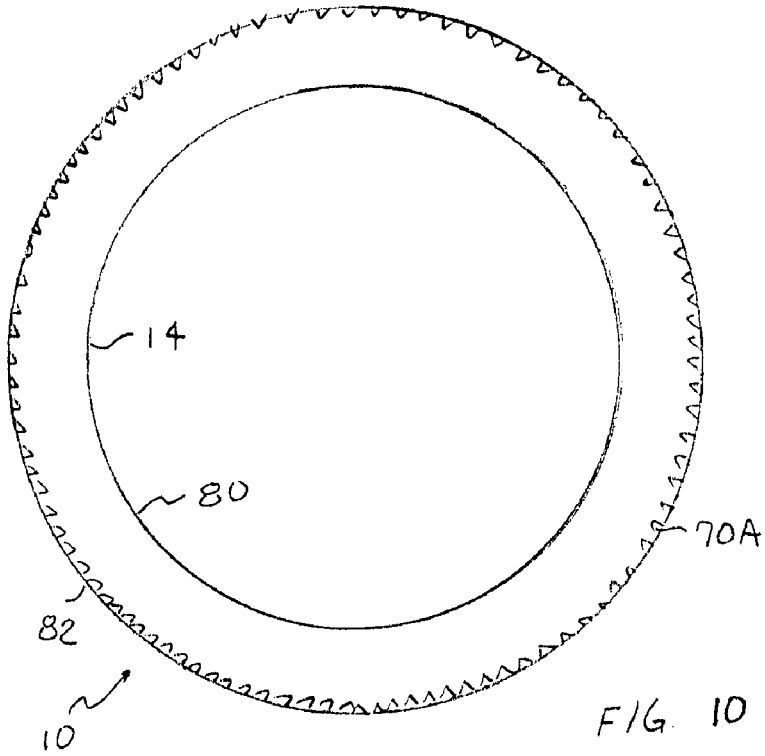
FIG. 10 is a top view drawing of a rim depicted in FIG. 1, with the top removed, showing a second cup holder diffuser option.

FIG. 10 shows another diffuser possibility. FIG. 10 shows a top view of the rim 14 with the base's top 50 removed (see FIG. 1). This second diffuser 72A is on the inner side 80 of the rim 14. In this case, the second diffuser 72A is created by a set of parallel notches, which are vertical based on a typical installation of the cup holder 10, that define a series of triangular cross-section bodies.

Figure 11:
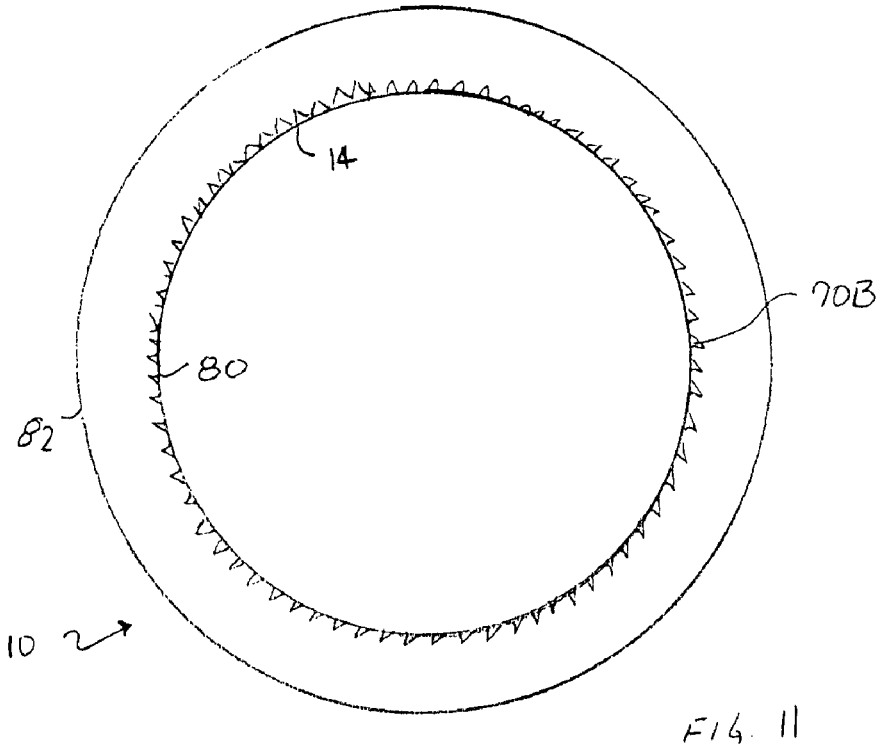
FIG. 11 is a top view drawing of a rim depicted in FIG. 1, with the top removed, showing a third cup holder diffuser option.

FIG. 11 shows yet another diffuser possibility. As with FIG. 10, FIG. 11 shows a top view of the rim 14 with the base's top 50 removed (see FIG. 1). The third diffuser 72B is on the outer side 82 of the rim 14. In this case, the third diffuser 72B is created by a set of parallel notches, which are vertical based on a typical installation of the cup holder 10, that define a series of triangular cross-section bodies.

It should be appreciated by those skilled in the art of lighting that the choice whether to employ a diffuser, and its location and design, are application dependent. Of the options presented, the options may be combined in numerous ways to obtain a desired lighting affect. In addition, the diffusers depicted should only be considered exemplary, as the choice of diffusers in nearly infinite.

Figure 12:
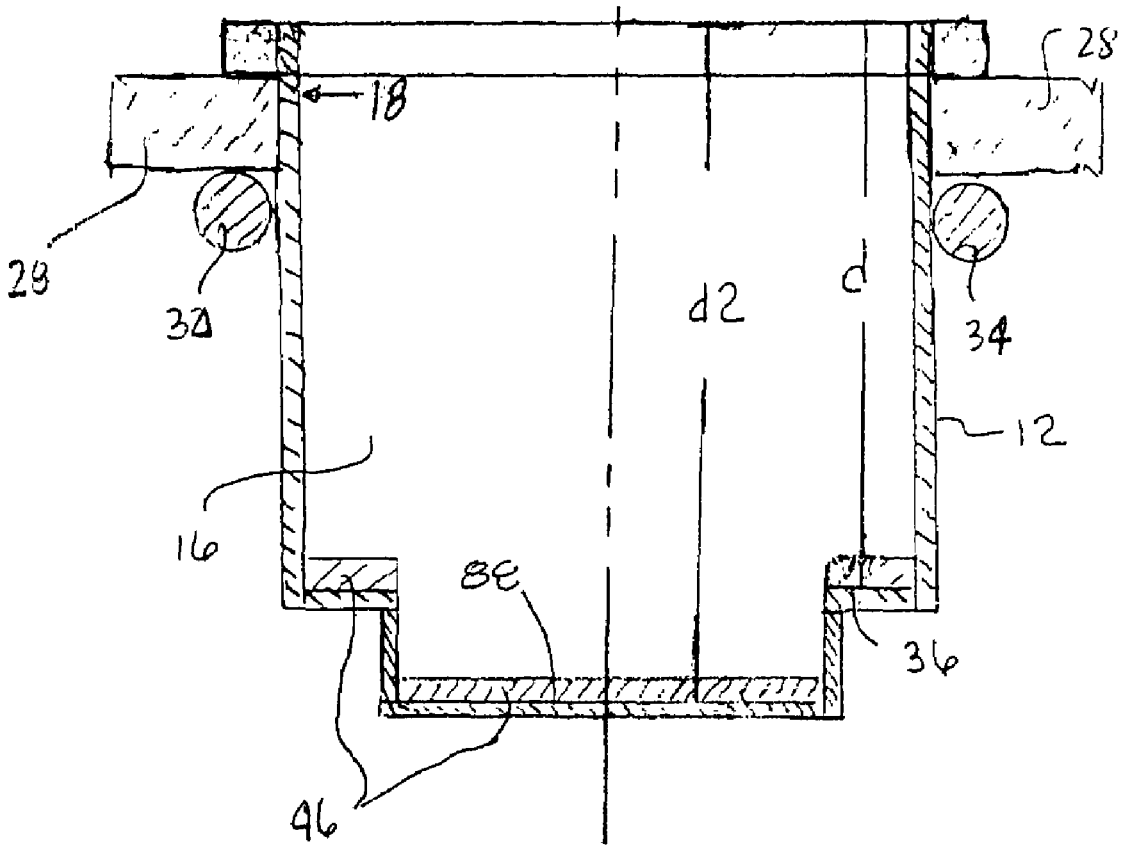
FIG. 12 is a sectional view drawing of a cup holder having a second step.

FIG. 12 shows a cup holder 10 having a second step 88. The second step 88 provides a second working depth d2, which may allow the cup holder 10 to accommodate a second taller container that it might not otherwise be able to accommodate properly. The second step 88 could have the pad 46. It should be appreciated that the second taller container, unless similarly stepped, will have a diameter smaller than that of the container. Thus, the clearance will be greater leading to increased wobbling of the second container in the cup holder 10.

Figure 13:
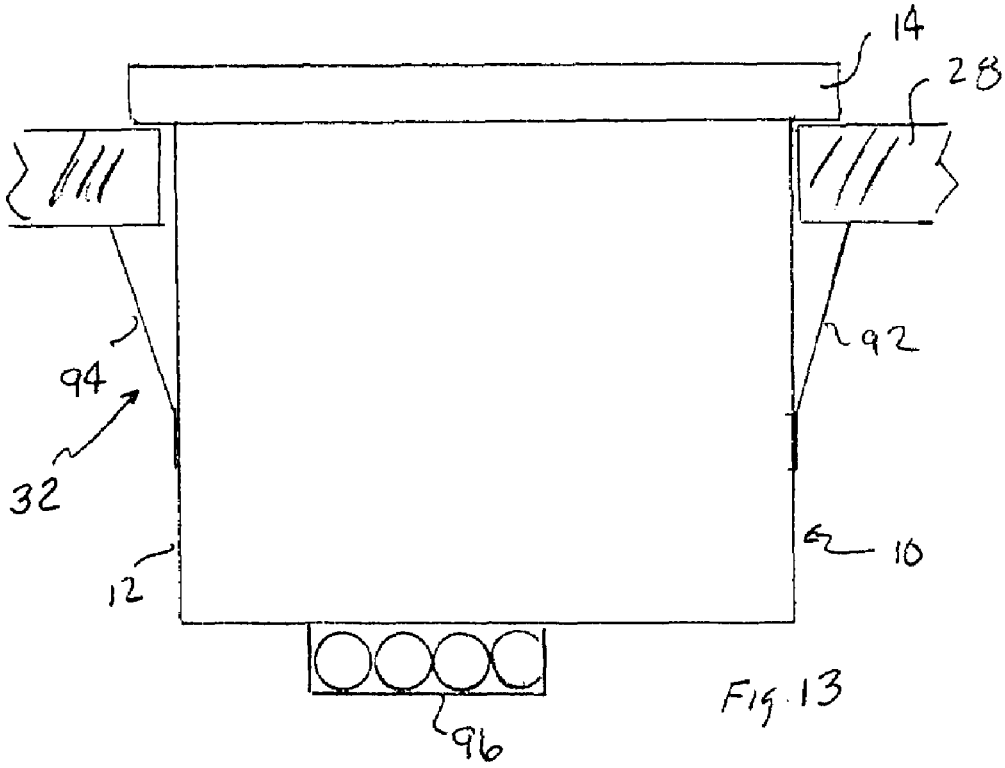
FIG. 13 is a side view drawing of a cup holder showing a second keeper system.

FIG. 13 shows a cup holder 10 having a second type of keeper 32. This second keeper 32 is a blind keeper. A blind keeper is one that can be engaged without having access to the backside of the cup holder. This keeper 32 has cooperating springs 92, 94. In use, the cup holder 10 is inserted through a hole 26 (See FIG. 1). During insertion, the springs 92, 94 are compressed against the body 12. At some point during insertion, the springs 92, 94 will clear the hole 26 and spring out into the position shown. As a result, the cup holder 10 will be prevented from being pulled from the hole.

As discussed above, the cup holder 10 includes a light source 68. As with any light source 68, a power source must be provided. If the cup holder 10 is self-contained, batteries in a battery pack may be used. As shown in FIG. 13, a battery pack 96 may be attached to the base 12. Where the cup holder 10 is to be installed through a hole, the battery pack 96 should be attached to the bottom of the cup holder, so as not to affect the size of the hole. In the alternative, the battery pack 96 could be mounted separately from the cup holder 10 (not shown). If a battery pack 96 is used, it should be accessible, either directly or by removal of the cup holder 10, to replace the batteries. Where removal is required, the cup holder 10 should be temporarily installed (e.g., using a keeper that can be removed and then reinstalled).

The wiring of the light source 68 is application dependent. As illustrated in FIGS. 1 and 3, the wiring is placed is a passage 98 that effective isolates the wires 99 from the inner surface 100, thus avoiding abrasion, which could lead to shorting or cutting of the wires. It is important to note that the passage 98 can be created in any number of ways from molding, drilling, or even providing a protective shield over an otherwise open channel. Protection of the wires is essential where the cup holder is to be friction fit and no other accommodation, such as a slot in the body, is being provided. In the alternative, the passage 98 could be a slot having an open side thereby permitting the wires 99 to pressed into the slot. Ideally, the slot would have a protective cover, which could be affixed to the base 12, in the area of the inner surface 100.

The wire gauge is based on the electrical requirements of the light source and the distance traveled from the power source. In a boating application, 16-gauge wire is most likely appropriate.

As shown in FIG. 8, a local switch 102 may be provided to turn the light source 68 on and off. If the local switch 102 is installed in the rim 14, it may be in a chamber similar to that previously described for the light units 70*a*, 70*b*. If a local switch 102 is provided, the environmental sealing of the local switch should consider the environment in which the cup holder is used. For example, a cup holder 10 used in a boating application should have a local switch 102 that is at least water resistant. This is particularly important where the local switch 102 is the only penetration into the rim 14.

While a self-contained cup holder 10 might use a local switch 102, a remote switch is possible. Alternatively, if the cup holder is integrated into an item, power may be provided from the item's power system. If this is the case, the local switch 102 may be eliminated, as an integrated cup holder 10 is ideally put on switched power.

Figure 14:
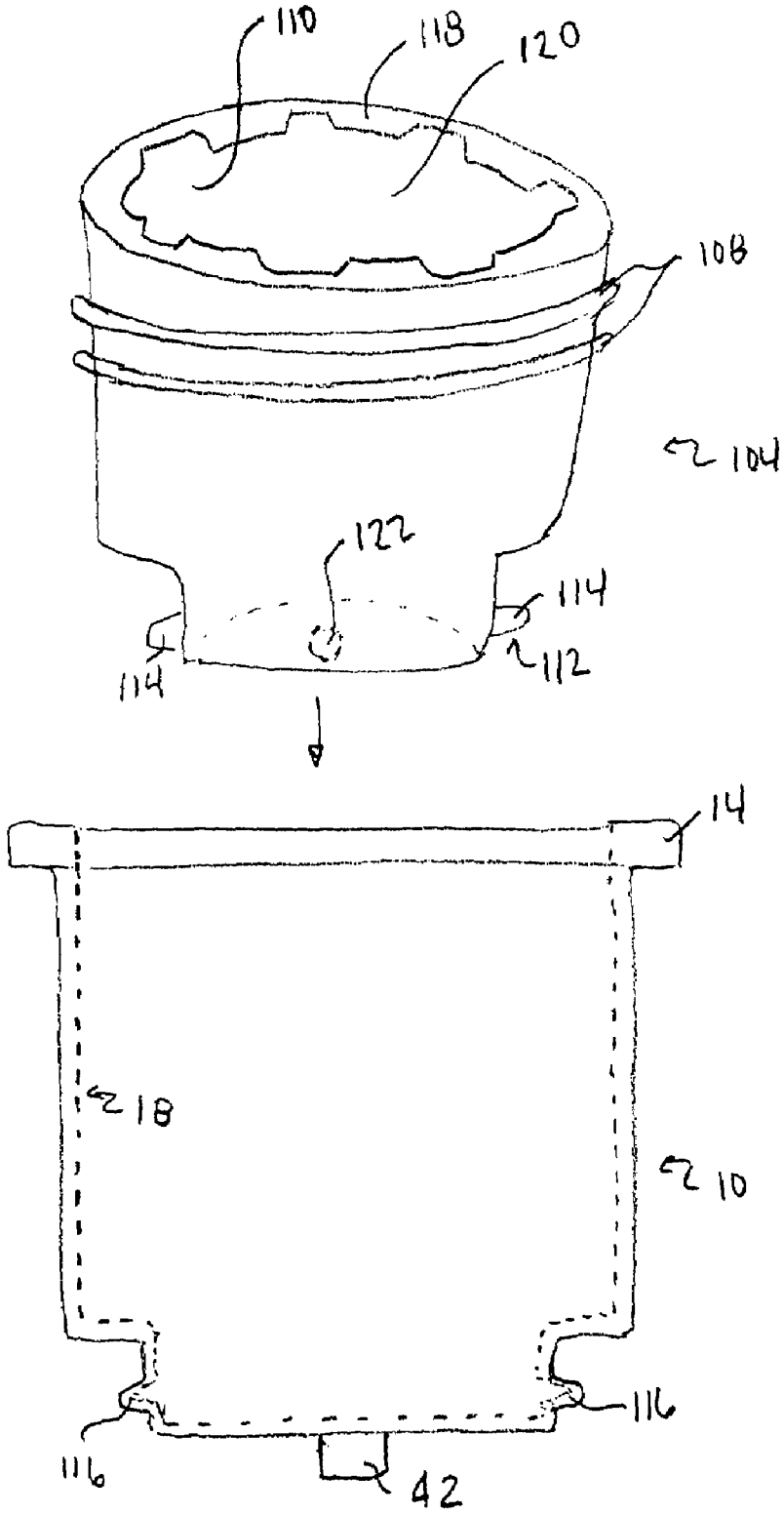
FIG. 14 is an exploded view drawing of a liner for insertion into a cup holder.

FIG. 14 shows an optional liner (generally referred to by reference number 104), which is generally used in lieu of the pad 46. The liner 104 is sized to fit into a cup holder 10. More specifically, the liner 104 has an exterior surface 106 that is ideally contoured to match the contour of the inner surface 18 of the cup holder 10. In the illustrative example, the cup holder 10 is of the multiple step design, but the discussion as to the removable liner is equally applicable to a single step design, such as that depicted in FIG. 1. Where the liner 104 is used in a cup holder 10 having a lighted rim 14, and the light is suppose to be visible on the inside the cup holder, the liner should have a height such that it does not cover the inner side of the rim.

The liner 104 may include at least one rib 108. The rib 108 extends outwardly from the liner 104 such that when the removable liner is placed in a cup holder 10, the rib compresses and contacts the inner surface 18 to exert a force onto the inner surface. Ideally, the at least one rib 104 is made of a compressible material, such as rubber, so the force is increased. The at least one rib 104 can be created in numerous ways. For example, the at least one rib 104 could be a molded protrusion of the removable liner 104, or be an o-ring that is positioned around the liner 104. It should be appreciated that if an at least one rib 108 present, the liner 104 should have sufficient rigidity such that the force exerted by the at least on rib on the exterior surface 106 does not cause deformation of the removable liner's inner surface 110.

The liner 104 may also include a liner keeper 112. A liner keeper 112 provides more than frictional force to retain the liner 104 in the cup holder 10. As illustrated, the liner keeper 104 includes cooperating tabs 114 that insert into indentations 116 in the cup holder 10. It should be appreciated that the tabs 114 and/or the liner 104 must be made such that the tabs can be temporarily relocated such that they can then "spring" into the indentations 116 upon insertion of the liner 104 into the cup holder 10. As the tabs 114 are in the indentations 116 there is an abutting force, a non-friction force, that will be created if one attempts to remove the liner 104 from the cup holder 10.

If the liner 104 is to be removable and then re-insertable (e.g., as for cleaning), the tabs 114 and/or liner 104 must be made to permit the tabs to be temporarily relocated out of the indentations 116 so the liner 104 can be non-destructively removed from the cup holder. For example, if the liner 104 were made from a pliable material, such as rubber, the tabs 114 might merely rotate and "pop" out and then be "popped" back in. Where the liner 104 is made from a rigid material, the tabs might be retractable toward the center of the liner, much like a spring-loaded plunger.

The indentations 116 could be of almost any design, such as plurality of discrete indentations or a continuous indentation, which extends around the entire perimeter of the cup holder 10. Where the indentations are not continuous, there would of course have to be an indentation for every tab.

The liner 116 may also include cooperating fingers 118. The cooperating fingers 118 extend inwardly proximate an opening 120 through which an object to be placed within the cup holder 10 is inserted. Ideally, the fingers 118 are flexible thereby permitting the fingers 118 to move, most likely deflect in the direction of movement of an object being inserted, thereby increasing the opening into the liner 116 and the permit the object to be withdrawn. The degree to which the fingers 120 extend inwardly into the liner 104 is a matter of design choice considering the size of the objects to be inserted and the number of steps incorporated into the design of the cup holder 10. More specifically, the fingers 120 may extend inward sufficiently to support an object that will sit on a step below the first step. As discussed above, object which sit on steps below the first step have smaller diameters thus have a tendency to wobble more in the cup holder 10. Fingers 120 can reduce this wobble.

The liner 104 may also include a drain 122, such as the gravity drain illustrated. The drain 122 permits liquids that may be captured within the liner 104 to be removed by a drainage system. The drain 122 in all likelihood will cooperate with the drain 42, if present, of the cup holder 10.

Where exposure to ultra violet light is an issue, such as from sun light in a boating application, the material chosen for the liner 104 should at least be ultraviolet resistant material.

Figure 15:
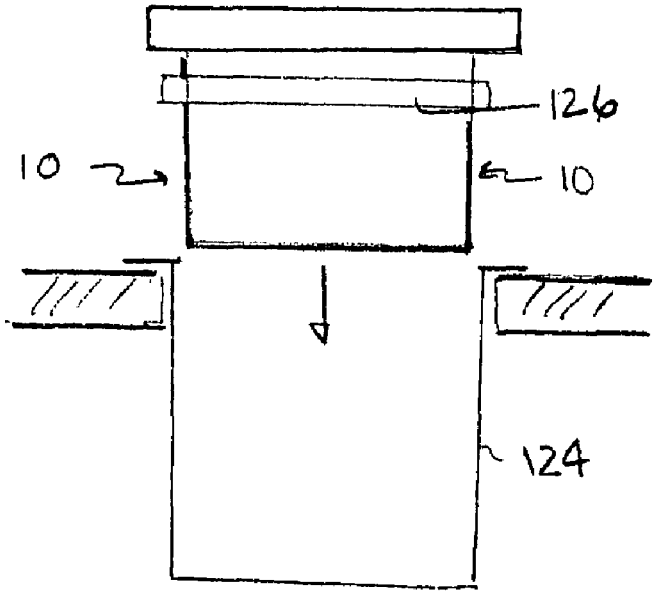
FIG. 15 is a side view drawing of a cup holder being used in a retrofit application.

FIG. 15 shows the cup holder 10 being used as a retrofit. In a retrofit item, the cup holder 10 is inserted into to existing cup holder 124. A keeper 32 may be provided. One type of keeper 32 that could be used is a compression ring 126.

Figure 16:
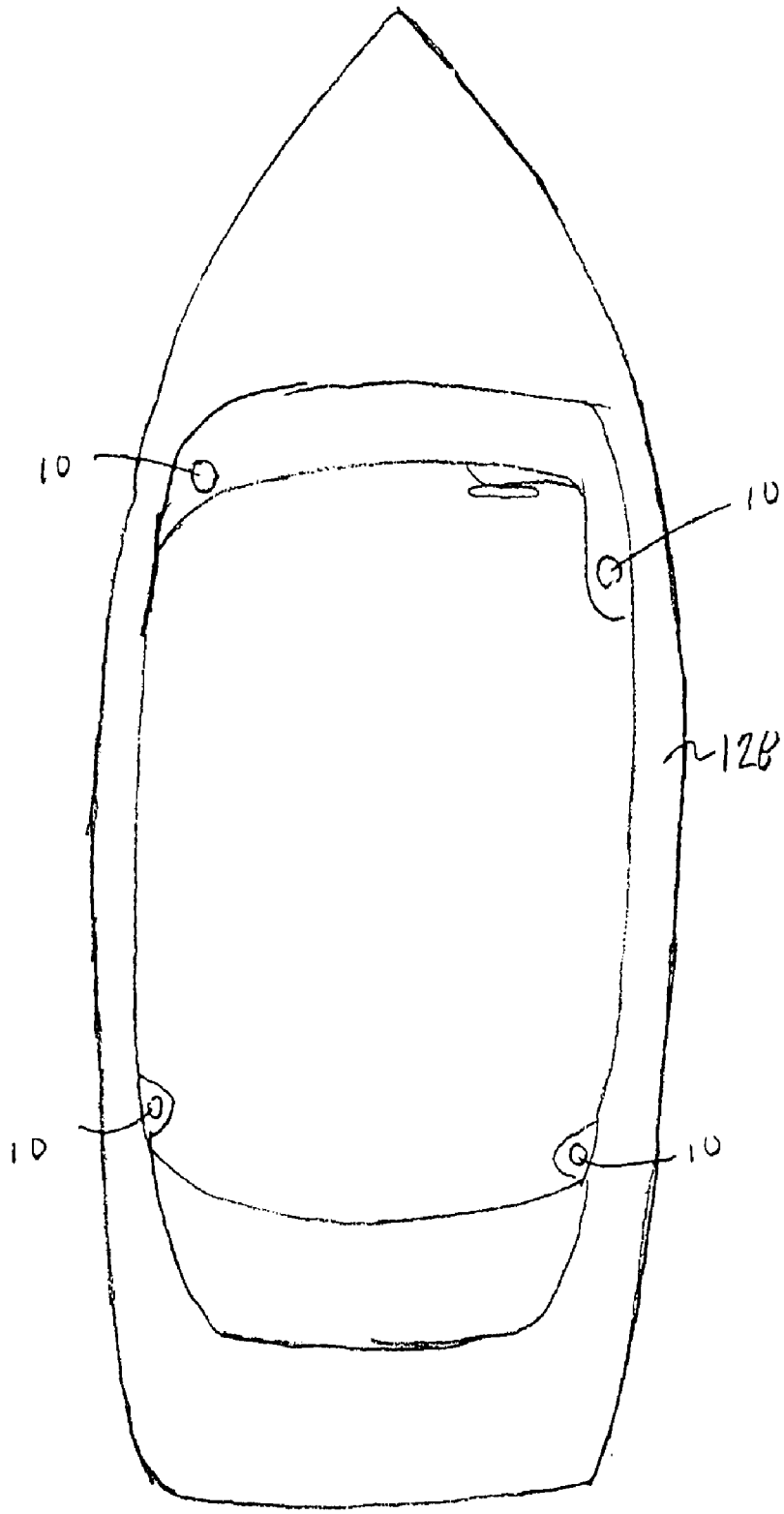
FIG. 16 is a top view drawing of a boat hull having several lighted cup holders installed therein.

As shown in FIG. 16, the cup holder 10 can be installed in a boat hull 128. When installed, the cup holders 10 when lighted are easily found in the dark. Additionally, cup holders having red lights could be installed on the port side and cup holders having green lights could be installed on the starboard side.

The cup holder 10 may be made from numerous materials. Where corrosion is an issue, plastic or stainless steel (e.g., 316) is preferred. It should be remembered that the cup holder 10 will generally be installed through a hole 26 of a body 28. Thus, if the base 12 of the cup holder 10 is clear it will act as a window to the inside of the body 28. If some plastics are used, pigmenting of the plastic cannot make the cup holder completely opaque. Thus, a coating or sleeve that obscures the view may need to be considered. One option to reduce transparency is sand blasting of the base. It should be appreciated the precise design of the rim 14 is item dependent. As the rim 14 contains a light source 68, at least a portion of the rim should be transparent. Additionally, if a non-transparent cap 40 is used, then the at least a portion of the rim that is transparent should not be blocked by the cap. It should be appreciated that the cap 40 can incorporate features such as holes to effectuate a light pattern.

While there has been illustrated and described what is at present considered to be preferred and alternative embodiments of the claimed invention, it will be appreciated that numerous changes and modifications are likely to occur to those skilled in the art. It is intended in the appended claims to cover all those changes and modifications that fall within the spirit and scope of the claimed invention.

What is claimed is:

1. A cup holder comprising;

a base having an interior surface defining a base channel having an opening and having a bottom, a rim attached to and extending outwardly from the base, the rim defining an enclosed rim channel and the rim having a perimeter, the perimeter having at least some portion that is translucent; and a light source positioned in the enclosed rim channel, whereby the light source illuminates the rim through the at least some portion that is translucent.

2. The cup holder of claim 1 wherein the perimeter has a bottom side that defines a groove.

3. The cup holder of claim 1 further including a keeper that interacts with the base to secure the cup holder in a body.

4. The cup holder of claim 3 wherein the keeper is of a non-blind style.

5. The cup holder of claim 3 wherein the keeper is of a blind style.

6. The cup holder of claim 1 further including a cap that is positioned on the rim.

7. The cup holder of claim 6 wherein the cap is non-transparent and the rim has a translucent top surface and the cap blocks light from exiting the top surface of the rim.

8. The cup holder of claim 1 further including a diffuser positioned in the enclosed rim channel.

9. The cup holder of claim 8 wherein the diffuser and rim define a light passage and the light source projects light into the light passage.

10. The cup holder of claim 9 wherein the light channel is generally continuous around the rim.

11. The cup holder of claim 1 further including ridges, the ridges being on an exterior surface of the base.

12. The cup holder of claim 1 further including a switch for controlling the light source.

13. The cup holder of claim 1 wherein the cup holder has a working depth for a standard 12-ounce can, the working depth being suitable for a boat installation.

14. The cup holder of claim 1 wherein the light source color is selected from a group consisting of red and green.

15. The cup holder of claim 1 further including a liner, the liner having a liner keeper that engages an indentation defined by the base.

16. The cup holder of claim 1 wherein the light source has a lighting pattern.

17. The cup holder of claim 1 wherein the enclosed rim channel extends radially outward from the base.

18. A boat comprising;

a hull; and a cup holder mounted on the hull, the cup holder having a base having an interior surface defining a base channel having an opening and having a bottom, a rim attached to and extending radially outwardly from the base, the rim and base defining an enclosed rim channel and the rim having a perimeter, the perimeter having at least some portion that is translucent; and a light source positioned in the enclosed rim channel, whereby the light source illuminates the rim through the at least some portion that is translucent.

19. The boat of claim 18 further including an electrical system associated with the hull, the light source being integrated into the electrical system.

20. The boat of claim 18 having at least two cup holders, one cup holder having a red lighting source and another having a green lighting source.

21. The boat of claim 20 wherein the hull has a port and starboard side and the cup holder having the red lighting source is mounted on the port and the cup holder having the green lighting source is mounted on the starboard.

* * * * *